US005564728A

United States Patent [19]

Renaud-Goud

[11] Patent Number: 5,564,728

[45] Date of Patent: Oct. 15, 1996

[54] DEVICE FOR SUPPORTING A BOOT ON A SKI

[75] Inventor: Gilles Renaud-Goud, Annecy, France

[73] Assignee: Salomon S.A., Annecy, France

[21] Appl. No.: 288,054

[22] Filed: Aug. 10, 1994

[30] Foreign Application Priority Data

Aug. 13, 1993 [FR] France ..... 93 10058

[51] Int. Cl.[6] ..... A63C 11/00

[52] U.S. Cl. ..... 280/636

[58] Field of Search ..... 280/636, 633, 280/634, 607

[56] References Cited

U.S. PATENT DOCUMENTS 4,688,822 8/1987 Dimier et al. ..... 280/636
4,869,525 9/1989 Gallet et al. ..... 280/636
4,951,961 8/1990 Boussemart et al. ..... 280/636

FOREIGN PATENT DOCUMENTS 2615748 12/1988 France .
2500686 8/1975 Germany .

*Primary Examiner*—Richard M. Camby
*Attorney, Agent, or Firm*—Pollock, Vande Sande & Priddy

[57] ABSTRACT

A device for supporting a boot on a ski, comprising a PTFE plate (7) assembled by direct contact and intimate surface bonding to a support (8) made of a thermo-hardening material, more specifically thermo-hardening rubber. On its surface, the device incorporates a raised pattern produced by deformation of the PTFE plate during the molding of its support (8) and resulting from the vulcanization reaction. Furthermore, vulcanization ensures assembly of the plate to its support.

10 Claims, 2 Drawing Sheets

DEVICE FOR SUPPORTING A BOOT ON A SKI

FIELD OF THE INVENTION

The invention concerns a device for supporting a boot on a ski, in particular, but not exclusively, on an alpine ski.

The invention also relates to a ski binding equipped with this device.

BACKGROUND OF THE INVENTION

A boot is generally held in position on an alpine ski by means of bindings which hold its ends in place while permitting the release of one or the other of the ends when the boot generates excessive stress. Furthermore, the ends of the boot rest on support devices, or plates. To facilitate the release of the boot, use is normally made of support plates exhibiting low levels of friction.

In particular, the support plate used for the front end is encased in a covering made of an anti-friction material, most notably of polytetrafluorethylene, herein called PTFE.

Assembly of this covering to its support is a relatively tricky operation because of the anti-adhesive properties of PTFE. Moreover, the assembly must withstand climatic conditions to which the bindings are subjected i.e., snow, ultra-violet rays, temperature changes, etc.

French Patent Application No. 2,533,832 describes the bonding of these PTFE coverings using a double-sided adhesive or a cyanoacrylate- or isocyanate acrylic-type glue. For improved effectiveness and strength of the bond, the lower surface of the PTFE preliminarily undergoes surface pre-treatment, e.g., a treatment with sodium naphthalene or sodium ammonia. In addition, fillers are incorporated into the material composing the plate in order to slow the penetration of ultra-violet rays and deterioration of the bond.

This technique yields good results, but its implementation is relatively complex and costly.

French Patent Application No. 2,615,748 discloses a support device incorporating a covering made of PTFE, which is assembled to a support by a mechanical process such as latching, drawing, riveting, embedding, etc.

This technique has the advantage of making the bonding operation unnecessary. However, because the PTFE coverings are no longer glued, the assembly process must make it possible, first, to mount the coverings easily in their support, and second, to provide reliable position-retention of the coverings in their support.

In fact, when the binding is used in conjunction with a worn boot, the friction increases between the coverings and the boot sole. In this case, the boot must be prevented from drawing the covers laterally out of their supports.

SUMMARY OF THE INVENTION

It is an object of the invention is to propose a boat-supporting device whose anti-friction covering is mounted without adhesive bonding and is solidly held in place on its support.

The invention is further intended to propose a support device exhibiting simplicity of assembly of the covering to its support.

The invention is also intended to propose a support device allowing ease of shaping of the upper surface.

In addition, the invention is intended to propose a support device possessing very good anti-friction properties.

Other purposes and advantages will emerge during the following description.

In accordance with the invention, the support device has a polytetrafluorethylene (PTFE) plate which is unfinished and which is assembled by direct contact and intimate surface bonding to a support made of a thermo-hardening material.

BRIEF DESCRIPTION OF THE DRAWINGS

The invention will be better understood by referring to the description below and to the attached drawings forming an integral part thereof.

DESCRIPTION OF THE PREFERRED EMBODIMENT

Figure 1:
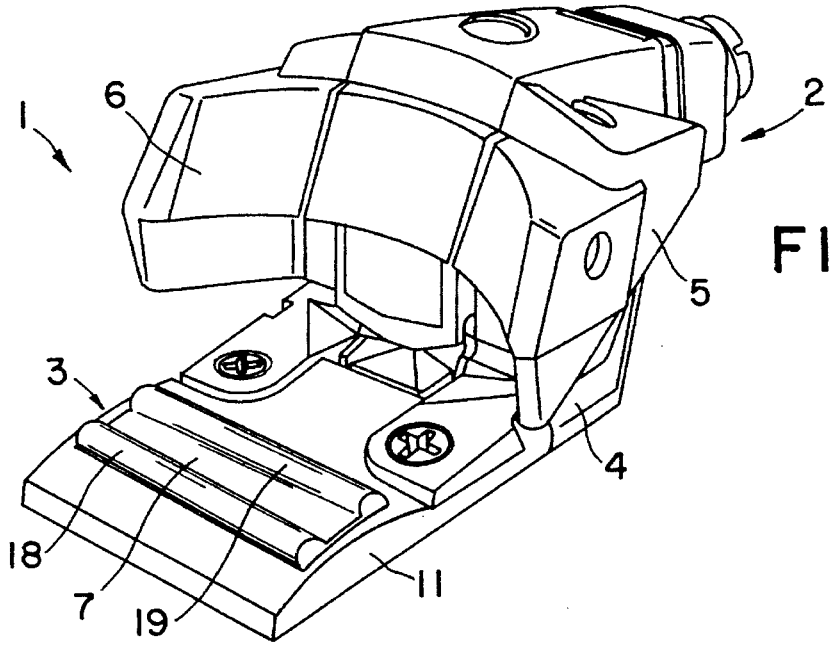
FIG. 1 is an overall perspective view of a front binding equipped with a support device according to a first, embodiment of the invention.

FIG. 1 is a perspective view of a front binding 1, which comprises a binding element 2 and a device 3 for support of the sole of the boot.

The binding which is of any suitable type and will not be described in detail, comprises a base 4 surmounted by a body 5 which incorporates at the rear a jaw 6 for holding the boot in place. The binding is assembled to the ski using any suitable means, e.g., screws which are inserted through holes in the base.

In the embodiment illustrated, the support device 3 is connected to the base, which it extends rearward. This arrangement is not restrictive, however, and the support device could be separate or joined to any other component.

The upper part of the support device incorporates an anti-friction covering produced from a plate 7 made of polytetrafluorethylene (called hereinafter PTFE). This PTFE plate 7 is borne by a support 8 having the overall shape of a rectangular parallelepiped, to which the plate is assembled.

Improved results have been obtained using a PTFE plate, one of whose faces has undergone a conventional chemical pre-treatment designed to enhance adhesion. Unfinished PTFE may also be used. The plate can also be produced from natural PTFE or PTFE filled with colored pigments.

The support and the PTFE plate are assembled to the rest of the binding by any suitable means. In accordance with the embodiment illustrated, the support rests on a base plate 10 whose front part engages beneath and is attached to the base. A position-maintenance cover 11 encloses the support 8 and the plate 7. The cover has an opening 12 whose dimensions correspond to the planar dimensions of the assembly composed of the support 8 and the plate 7 but whose height is smaller than the height of the support, so that the PTFE plate 7 projects outward above the cover. The cover is assembled to the base plate by any suitable means, e.g., by elastic deformation using claws which fit into corresponding recesses in the base plate.

The lower portion of the support 8 advantageously has edges 13, 14 which are inserted in corresponding recesses 15, 16 in the cover.

Figure 2:
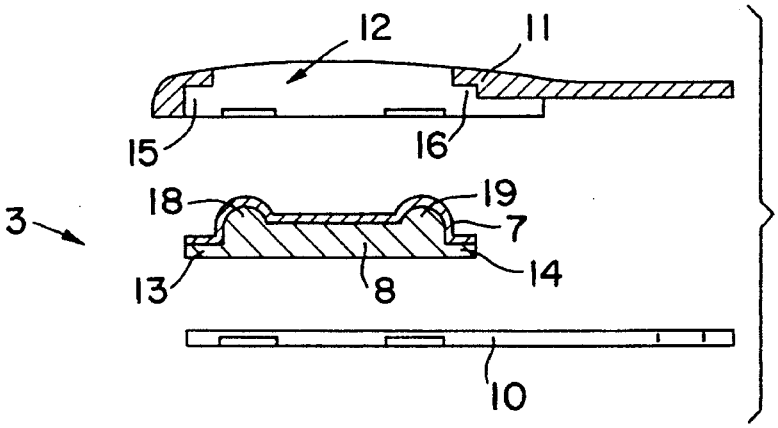
FIG. 2 is an exploded view in transverse cross-section of the support device in FIG. 1.

As illustrated in FIG. 2, the PTFE plate preferably extends downward along the edges 13 and 14 of the support. Along at least one of its edges, the plate is thus held locked in place by the cover assembly, thereby making it less likely to be torn away in these areas.

Furthermore, the upper surfaces of the PTFE plate has a raised pattern which, as illustrated in FIGS. 1 and 2, is shaped like two longilinear rolls 18, 19 extending transversely.

FIG. 2 shows that, in fact, the shape of the PTFE plate conform to the contour of the raised pattern on the upper surface of the support 8 itself.

The raised pattern on the PTFE plate causes a reduction and fragmentation of the contact surface between the support device and the sole of the boot. It is believed that this fragmentation of the contact surface reduces friction between the boot sole and its support, and that it thus improves the sliding capacity of the support device.

The support 8 is made of a thermo-hardening material, more specifically of a thermo-hardening rubber. This material proves advantageous because, depending on the specific chemical composition and the method of production of the thermo-hardening rubber, the final support plate 8 can be relatively hard or, to the contrary, relatively flexible, and may possess damping properties, as the case requires. A hard support plate provides a firm support for the boot, while a flexible support plate enhances comfort and shock-absorption.

Furthermore, thermo-hardening rubber allows direct assembly to the PTFE plate 7 without adhesive. The assembly results from a surface chemical reaction when the rubber is vulcanized, i.e., during the final manufacturing operation which gives the rubber its shape and final consistency.

This operation generally takes place in a mold having the desired shape, in which a rubber wafer is placed and which is heated for a determinate period in order to stimulate the vulcanization reaction, which causes expansion of the rubber wafer in the mold cavity and the hardening thereof.

It was further noted that, if the PTFE plate 7 is preliminarily placed into the mold, it can be assembled to the support directly by means of an intimate surface bond. It was further noted that, if a flat PTFE plate is placed into a mold incorporating a raised pattern, the plate becomes deformed under the pressure of the rubber undergoing vulcanization so as to take on the shape of the mold wall. The PTFE is, in fact, a relatively soft material which easily lends itself to deformation by bending or even by plastic flow.

Figure 3:
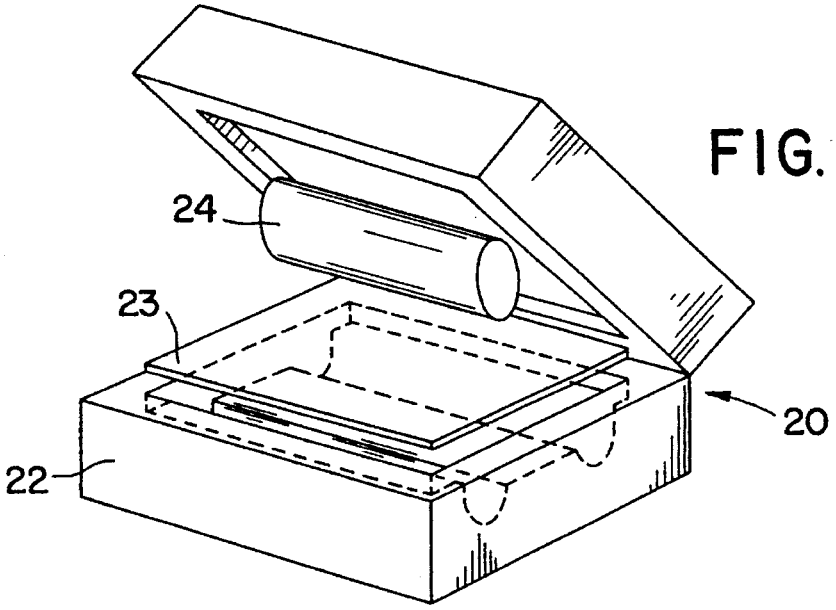
FIG. 3 is a view illustrating the method of manufacture of the support device.

FIG. 3 schematically illustrates this manufacturing process. It shows a two-part mold 20, part 22 of which embodies, in reverse fashion, the raised pattern ultimately desired, in the present instance the aforementioned two rolls.

A PTFE plate 23 and a thermo-hardening rubber wafer 24 are placed in the mold. The plate 23 advantageously has, extending transversely, a width substantially equal to the width of the mold impression and, longitudinally, a dimension larger than the overall dimension of the mold, as a function of the final shape desired. However, the PTFE plate can also be deformed into a bell shape, so that it covers all of the lateral edges of the support plate. The mold is closed and heated, so as to initiate vulcanization of the rubber. The rubber expands, thus pushing the PTFE plate back against the wall of the mold, and ensures assembly of the support and the plate, thereby imparting to the assembly its final shape. It may be noted that the covering of the edges 13 and 14 by the plate 7 is effected during this operation.

This manufacturing process makes it possible to produce any raised pattern.

FIGS. 4 to 7 illustrate different possible raised patterns.

Figure 4:
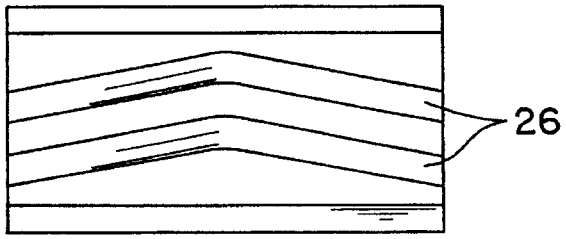
FIGS. 4 to 7 illustrate variants of the invention.

In FIG. 4, the PTFE plate is deformed to produce two transverse chevron shapes.

Figure 5:
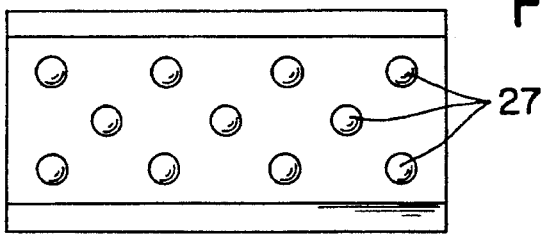

In FIG. 5, the PTFE plate incorporates a plurality of round projections 27.

Figure 6:
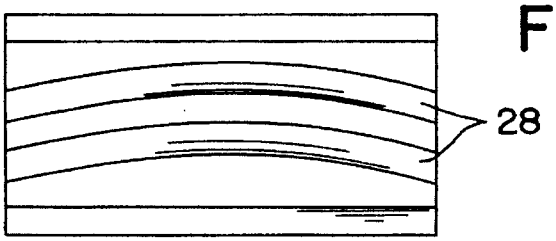

In FIG. 6, the raised pattern is shaped like two curved rolls 28 whose center of curvature is located in the area of the heel of the boot.

Figure 7:
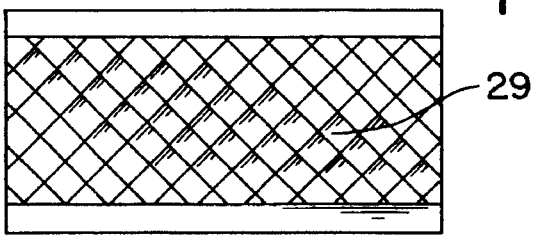

FIG. 7 schematically illustrates a waffle-shaped raised pattern 29.

Obviously, neither the aforementioned shapes nor the number of elementary raised patterns is restrictive.

Figure 8:
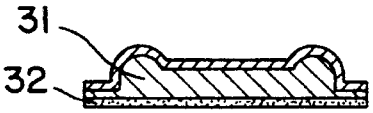
FIG. 8 illustrates another variant of the invention.

FIG. 8 illustrates a variant in which the support plate is produced in two layers exhibiting different properties. For example, the upper layer 31 is relatively hard, so as to provide a clear-cut, solid footing for the boot.

The lower layer 32 is thinner and more flexible, and preferably exhibits damping properties. Its function is to absorb shocks and vibrations transmitted between the ski and the boot during skiing.

This support plate is produced by superposing in the mold several rubber wafers, which then intimately merge at their contact surfaces.

What is claimed:

1. Device for supporting a boot on a ski, comprising a plate made of polytetrafluorethylene (PTFE) (7), wherein said PTFE plate (7) is assembled by direct adherence free of adhesive, and intimate surface bonding to a support (8) made of thermo-hardening vulcanized rubber.

2. Device according to claim 1, wherein said plate (7) comprises an upper contact surface incorporating a raised pattern.

3. Device according to claim 2, wherein said plate (7) takes on the shape of the raised pattern embodied on the upper face of its support (8).

4. Device according to claim 2, wherein said raised pattern comprises on its surface at least one longilinear roll (18, 19) extending transversely.

5. Device according to claim 2, wherein the raised pattern comprises at least one chevron shape.

6. Device according to claim 2, wherein the raised pattern is waffle-shaped.

7. Device according to claim 2, wherein the raised pattern comprises a plurality of round projections distributed over the upper surface of said plate.

8. Device according to claim 2, wherein said plate (7) extends downward along at least a portion of the edges of the support (8).

9. Device according to claim 2, wherein said raised pattern is produced by deformation of a flat plate (23) made of unfinished PTFE against a wall of a mold (20) incorporating a reversed raised pattern during molding and vulcanization of the support made of thermo-hardening rubber,

10. Ski binding equipped with a support device according to claim 1.

* * * * *